US005522545A

United States Patent [19]

Camplin et al.

[11] Patent Number: 5,522,545

[45] Date of Patent: Jun. 4, 1996

[54] HYDRAULICALLY ACTUATED FUEL INJECTOR

[75] Inventors: Frederick A. Camplin; Jeffrey C. Huang, both of Peoria, Ill.

[73] Assignee: Caterpillar Inc., Peoria, Ill.

[21] Appl. No.: 378,293

[22] Filed: Jan. 25, 1995

[51] Int. Cl.[6] ..... F02M 47/02

[52] U.S. Cl. ..... 239/92; 239/533.3

[58] Field of Search ..... 239/88–92, 533.3–533.12

[56] References Cited

U.S. PATENT DOCUMENTS

| | | | |
|---|---|---|---|
| 3,326,191 | 6/1967 | Berlyn | 123/32 |
| 3,442,451 | 5/1969 | De Nagel | 239/89 X |
| 3,837,324 | 9/1974 | Links | 123/139 |
| 3,921,604 | 11/1975 | Links | 123/139 |
| 4,006,859 | 2/1977 | Thoma | 239/89 |
| 4,222,358 | 9/1980 | Hofbauer | 239/92 X |
| 4,276,000 | 6/1981 | Warwicker | 417/302 |
| 4,385,609 | 5/1983 | Kato | 239/88 |
| 4,805,580 | 2/1989 | Buisson et al. | 123/506 |
| 4,903,666 | 2/1990 | Buisson et al. | 123/447 |
| 4,903,896 | 2/1990 | Letsche et al. | 239/88 |
| 5,121,730 | 6/1992 | Ausman et al. | 123/467 |
| 5,271,371 | 12/1993 | Meints et al. | 123/446 |
| 5,419,492 | 5/1995 | Gant et al. | 239/88 |

*Primary Examiner*—Kevin P. Weldon

*Attorney, Agent, or Firm*—Michael B. McNeil; Joseph W. Keen

[57] ABSTRACT

A hydraulically actuated fuel injector includes an intensifier piston with a tapered or conical protuberance and an injector body with a conical seat. During the pre-injection stage, the piston is spring loaded to seat its conical protuberance against the conical seat of the injector body. To start the injection, actuation fluid is admitted to the injector. The injector actuation volume is pressurized and the pressure acts initially only on the top of the conical protuberance of the piston. The displacement of the piston is temporarily retarded during the first stage of injection due to a throttling effect in allowing the high pressure fluid to act on the remaining top surface of the piston. The throttling effect is provided by the relatively narrow flow area between the conical protuberance and the conically shaped seat. The result being that the intensifier piston hesitates in its downward movement such that injection is either slowed or briefly stopped before the piston has moved sufficiently downward that the high pressure actuation fluid acts over the complete top side of the piston. As the conical protuberance of the piston clears its seat, unrestricted main injection begins.

6 Claims, 3 Drawing Sheets

HYDRAULICALLY ACTUATED FUEL INJECTOR

TECHNICAL FIELD

The present invention relates generally to hydraulically actuated fuel injectors, and more particularly to hydraulically actuated fuel injectors with clearance area controlled rate shaping capabilities.

BACKGROUND ART

It has long been known that combustion efficiency and exhaust emissions can be improved by injecting a small amount of fuel into the combustion chamber before main injection begins. This pre-injection is oftentimes referred to in the art as pilot injection and/or rate shaping. In the field of hydraulically actuated fuel injectors, pilot injection can be accomplished in a number of ways. One method is by controlling the initial velocity profile of a plunger that pressurizes the fuel at the beginning of each injection cycle. The movement of the plunger in a hydraulically actuated fuel injector can in turn be controlled by controlling the flow rate of the high pressure hydraulic fluid acting on the top face of the piston that supplies the downward force to the plunger. Thus, pilot injection can be accomplished by controlling the initial flow rate of the high pressure hydraulic fluid acting on the top surface of the piston in such a way that the piston hesitates momentarily in its downward movement.

One known method for creating an initial hesitation in the piston is to design geometrical relationships between the piston and the piston bore that prevent the high pressure hydraulic fluid from acting over the complete surface of the piston when the piston begins its downward movement. In other words, by exposing only a portion of the piston to high pressure hydraulic fluid initially, the piston hesitates in its downward movement until the complete upper surface of the piston is exposed to the high pressure hydraulic fluid. Unfortunately, these prior art geometrical interrelationships require such a high degree of precision machining that mass production of these injector components was not economically realistic. For instance, U.S. Pat. No. 3,921,604 to Links describes a fuel injector having an intensifier piston with a conical protuberance on its top side that projects into the high pressure hydraulic fluid supply bore. Links describes this geometry as giving the injector the ability to control the stroke speed of the piston, presumably because the conical portion prevents the high pressure fluid from flowing quickly to act on the remaining surface area of the piston. While Links does recognize that some injection rate shaping capability can be accomplished by the geometrical interrelationship between the piston and the high pressure hydraulic fluid supply bore, the Links geometry suffers from a number of disadvantages which render it difficult to reliably predict performance due to extreme sensitivity to machining tolerances.

In Links, there are several features of the piston and bore that have a significant influence on the velocity profile of the piston, which in turn controls the ejection rate profile. Among these features are bore diameter, base diameter of the conical protuberance, the height of the protuberance, the perpendicularlity of the piston shoulder surface and the perpendicularlity of the bore shoulder seating surface. Since all of these geometrical features of Links must be held to extremely tight tolerances, the Links injector is difficult to produce in large quantities with reliable and predictable performance.

The present invention is directed to overcoming one or more of the problems as set forth above.

DISCLOSURE OF THE INVENTION

A hydraulically actuated fuel injector includes an injector body with a cylindrical cavity positioned between an actuation fluid supply bore and a fuel pressurization chamber. The cylindrical cavity is defined by a side wall and a top surface that includes a conically shaped seat. A cylindrical piston mounted in the cavity is slidable between a first position and a second position, and has a top side that includes a protuberance with a conical portion that seats in the conically shaped seat when the piston is in its first position. The top side of the piston can also be divided into a first area and a second area which are acted upon by the high pressure actuation fluid during the injection event. The high pressure actuation fluid supply bore opens into the cylindrical cavity adjacent the top side of the cylindrical piston, which is biased toward its first position. The high pressure actuation fluid is in fluid contact with the first area of the piston when the piston is in its first position but is in fluid contact with both the first and second area when the piston is away from its first position. The second area of the piston and the cavity of the injector body define an expansion chamber with a volume. Movement of the piston from its first position toward its second position expands the volume of the expansion chamber. When the piston begins to move off its seat, the particular geometry defines an actuation fluid flow area between the conically shaped seat and the conical protuberance of the piston. The expansion chamber has an initial expansion rate that is limited by the actuation fluid flow area. As a consequence, pilot injection rate shaping is accomplished because the geometrical relationship between the cavity and the piston prevents the full pressure of the actuation fluid from acting over the whole area of the piston when the injection event begins, thus causing the piston to hesitate in its initial downward movement.

BEST MODE FOR CARRYING OUT THE INVENTION

Figure 1:
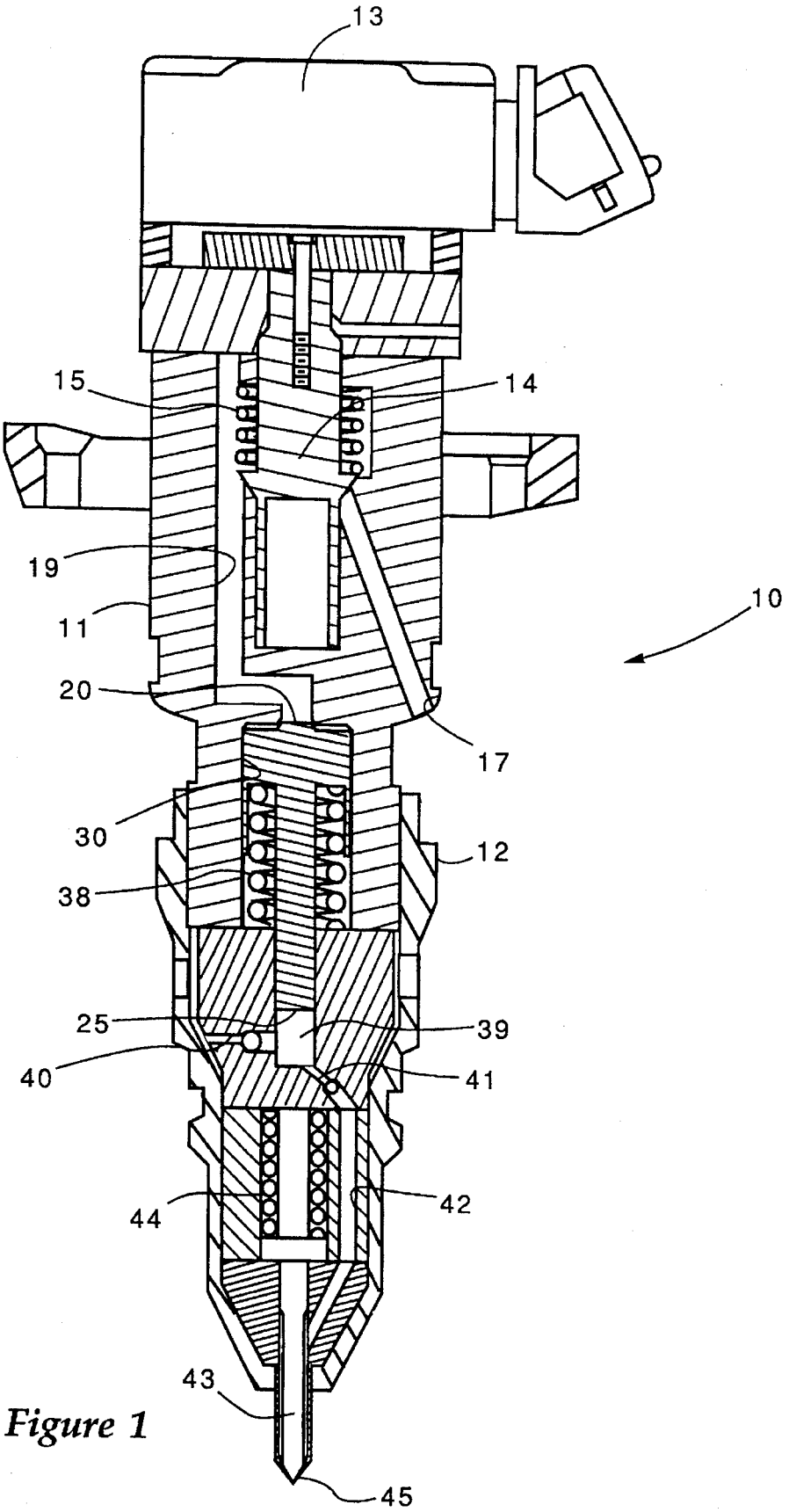
FIG. 1 is an enlarged cross-sectional view of a hydraulically actuated fuel injector according to the preferred embodiment of the present invention.

Referring now to FIG. 1, a hydraulically actuated fuel injector 10 according to the preferred embodiment of the present invention is illustrated. Fuel injector 10 is a Caterpillar Inc. hydraulically actuated electronically controlled fuel injector of the type described in detail in U.S. Pat. No. 5,121,730 to Ausman et al., which description is incorporated herein by reference. Nevertheless, a brief review of the various components of injector 10 will be useful in aiding those skilled in the art in understanding the present invention.

Fuel injector 10 includes an upper injector body 11 and a lower injector body 12 that together enclose the majority of passageways and components within the injector. The various components of injector 10 are positioned as they would be just before the initiation of an injection event. In particular, solenoid 13 is deactivated such that control valve 14 is seated by the action of compression spring 15 to close high pressure hydraulic fluid inlet 17 from actuation fluid supply bore 19. When control valve 14 is seated as shown, the hydraulic actuation fluid within supply bore 19 returns to a low pressure, such as atmospheric pressure ($P_{atm}$), by means more thoroughly described in the Ausman et al. patent. Because of the lower pressure in supply bore 19, piston 20 is forced to its seating position within cylindrical cavity 30 by compression spring 38. Attached directly to piston 20 is a plunger 25, which draws fuel into fuel pressurization chamber 39 through fuel inlet passage 40 during its upward return stroke. Although the piston 20 and plunger 25 are shown as an integral body, it is to be understood that they may be separate, engaged elements.

Injection is initiated when solenoid 13 is activated to lift control valve 14 off of its seat to allow high pressure hydraulic actuation fluid into supply bore 19 via high pressure hydraulic fluid inlet 17. The high pressure actuation fluid acting on the top surface of piston 20 is sufficient to make it move downward against the action of spring 38. Downward movement of piston 20 is accompanied by the downward movement of plunger 25 to compress and raise the pressure of fuel within fuel pressurization chamber 39. Downward movement of plunger 25 in turn causes the fuel to exit through bore 41 and bore 42 on its way to the needle check valve 43. The pressurized fuel then surrounds the shoulder of needle check valve 43 causing it to lift against the action of compression spring 44 when the fuel pressure reaches a threshold amount. When needle check valve 43 is lifted off its seat, fuel injection begins through nozzle 45.

In order to sustain injection, plunger 25 must continue its downward movement at a rate sufficient to maintain the fuel above a threshold pressure, which depends on the strength of spring 44. The present invention is concerned with controlling or varying the initial downward velocity of plunger 25 so that the needle check valve 43 initially lifts off its seat momentarily for pilot injection, injection rate briefly stops increasing by a momentary hesitation in the downward movement of plunger 25, and then injection again increases as main injection begins. Depending on engine operating conditions and what particular injection rate shaping is desired, the present invention is capable of creating a sufficient slowing or even hesitation in a downward movement of plunger 25 that injection may actually briefly stop with the needle check valve returning to its seat before main injection begins when the downward movement of the plunger resumes and accelerates. The present invention accomplishes this plunger action by controlling the rate at which the high pressure actuation fluid acts on the top surface of piston 20 through a geometrical relationship between the top side of piston 20 and the upper portion of cylindrical cavity 30.

Figure 2:
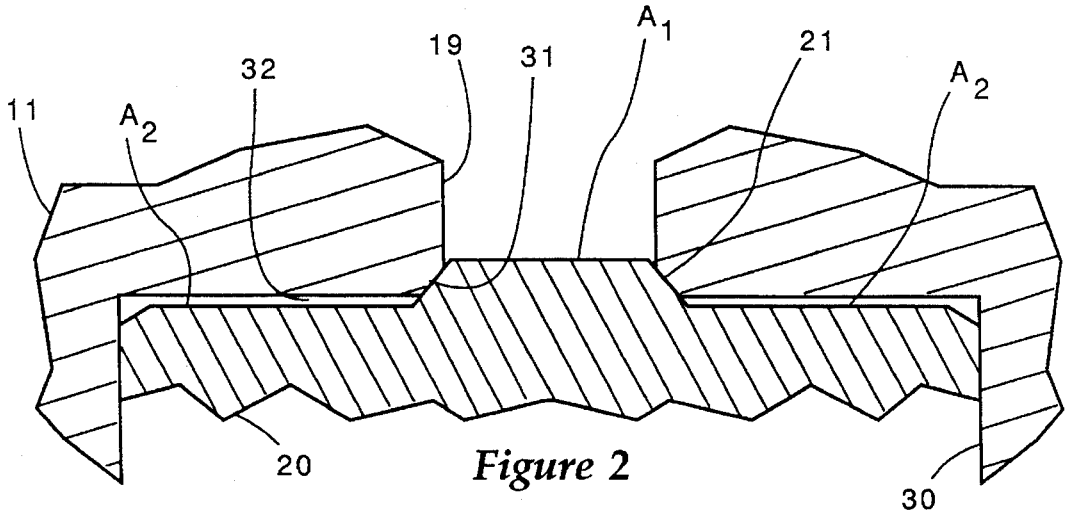
FIG. 2 is an enlarged cross-sectional view of the piston and cavity of the fuel injector of FIG. 1 before the injection event has begun.
Figure 3:
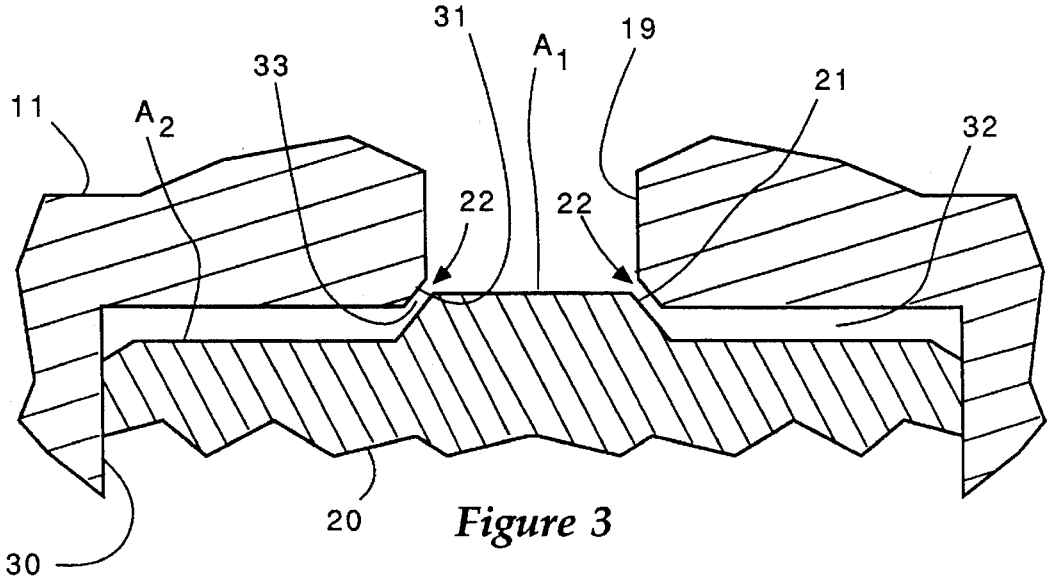
FIG. 3 is the same as FIG. 2 except showing the initial movement of the piston after the injection event has begun.

Referring now to FIGS. 2 and 3, an enlarged view of piston 20 and cylindrical cavity 30 is shown just before and just after an injection event has begun, respectively. The top side of piston 20 includes a conical protuberance 21 that seats itself within a conical seat 31 at the transition between actuation fluid supply bore 19 and cylindrical cavity 30. The seating surfaces are preferably of slightly differential angles to insure a consistent seating location when piston 20 is in its seated position as shown in FIG. 2. When seated, the top side of piston 20 can be thought of as being divided into a first area A1 that is always exposed to the fluid within actuation fluid supply bore 19 and a second area A2 that surrounds area A1. Although not absolutely necessary, it is preferable that area A2 be substantially closed to actuation fluid supply bore 19 when piston 20 is seated against conical seat 31. It is important to note that there remains a slight clearance between area A2 and the upper surface of cylindrical cavity 30 such that an annular expansion chamber 32 is created. Thus, when an injection event begins, the high pressure actuation fluid in supply bore 19 acts only on the first surface A1, and cannot act upon the second surface A2 to accelerate the downward speed of piston 20 until the piston moves off its seat as shown in FIG. 3. Of course, the high 10 pressure actuation fluid acting on area A1 must itself be sufficient to begin the movement of piston 20 against the action of its compression spring 38 (FIG. 1). When piston 20 begins its downward movement as shown in FIG. 3, an actuation fluid flow area 33 is created between the conically shaped seat 31 and the conical protuberance 21.

Hesitation in the downward movement of piston 20 is created because the actuation fluid flow area throttles the flow of actuation fluid 22 into expansion chamber 32. In other words, area A2 and the respective shapes, such as cone angles, of the conical seat 31 and conical protuberance 21 are chosen such that the expansion rate of expansion chamber 32 is limited by the size of actuation fluid flow area 33. This geometrical interrelationship, along with the ratio of area A1 to area A2, controls the initial speed of piston 20.

Figure 7:
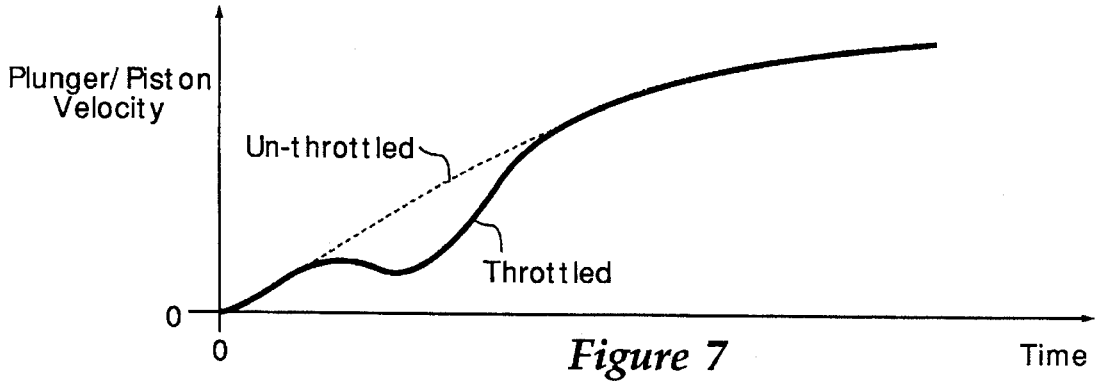
FIG. 7 is a graph showing plunger/piston velocity during the initial portion of an injection event.
Figure 8:
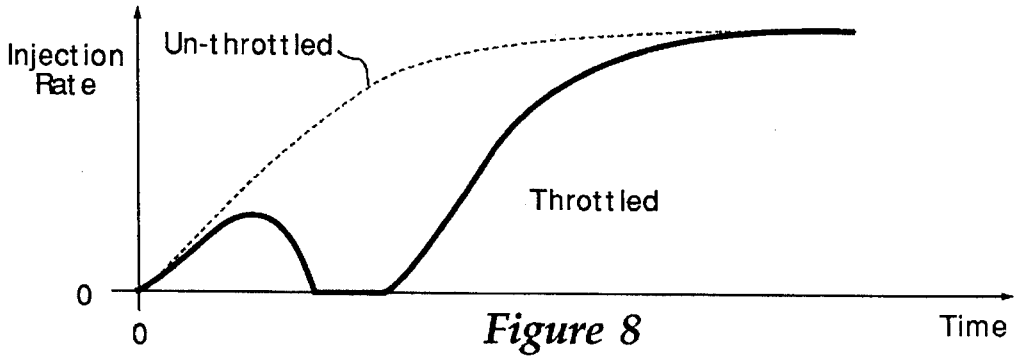
FIG. 8 is a graph showing fuel injection rate during an initial portion of an injection event according to one aspect of the present invention.

FIGS. 5 through 8 illustrate several injector parameters that are useful in understanding piston movement at the beginning of an injection event. All the graphs are plotted against a horizontal time axis which begins at time zero, which corresponds to when the solenoid 13 (FIG. 1) is activated to open control valve 14. At time zero, the control valve is at the closed position, the pressure within the supply bore is atmospheric such that the pressure on both area A1 and A2 are at atmospheric pressure, both the plunger and piston have zero velocity, and no fuel is yet being injected. As the control valve lifts, high pressure actuation fluid comes into contact with the fluid already in supply bore 19 such that the pressure P1 acting on area A1 begins to rise. As the pressure on area A1 begins to rise, it eventually reaches a threshold overcoming the biasing spring 38 and the piston begins its downward movement. At the same time, plunger 25 begins to compress the fuel within fuel pressurization chamber 39 and closes supply passage 40 by its check valve. Again at a certain threshold, the fuel pressure is sufficient to lift needle check 43 off of its seat so that fuel begins to be injected through nozzle 45. At the same time piston 20 begins its downward movement, the flow of actuation fluid 22 into expansion chamber 32 is throttled, which in some cases can actually result in a substantial pressure drop in the pressure P2 acting on area A2. This pressure drop causes piston 22 to slow or even hesitate in its downward movement as shown in FIG. 7. In some cases, depending upon the particular geometrical interrelationship of the components discussed earlier, the hesitation in the downward movement of piston 20 can actually result in the fuel pressurization chamber pressure dropping briefly below that necessary to lift needle check 43 off of its seat. Thus, as shown in FIG. 8, the needle check briefly closes until the conical protuberance 21 on piston 20 is sufficiently clear from the conically shaped seat 31 that high pressure actuation fluid is allowed to flow into expansion chamber 32 so that the high pressure actuation fluid can begin acting on the complete top side of piston 20. At such a point, piston 20's downward movement accelerates and main injection begins as shown in FIG. 8. For purposes of comparison, FIGS. 7 and 8 also show the action of an unthrottled piston which results in no pilot injection since the piston and plunger's movement is not interrupted.

Figure 4:
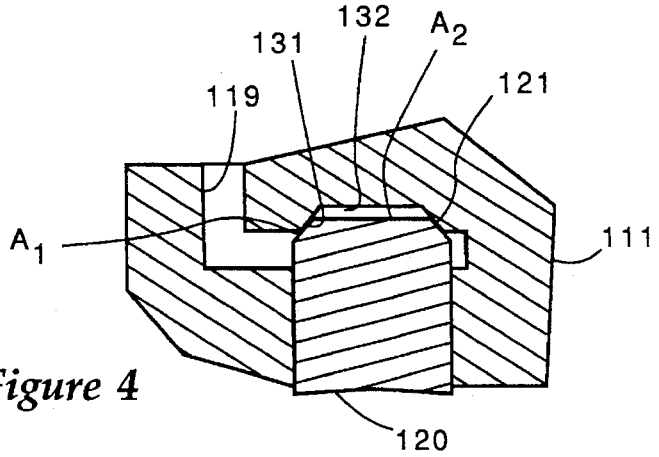
FIG. 4 is an enlarged partial cross-sectional view of a piston and cavity for a fuel injector according to another embodiment of the present invention.
Figure 5:
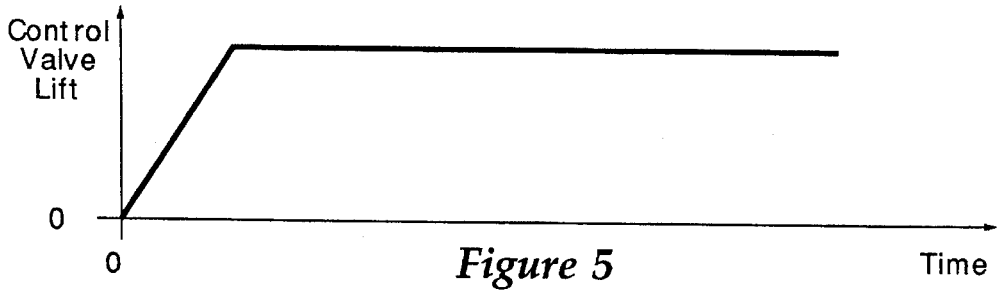
FIG. 5 is a graph of the position of the high pressure hydraulic fluid control valve position versus time during the initial portion of an injection event.
Figure 6:
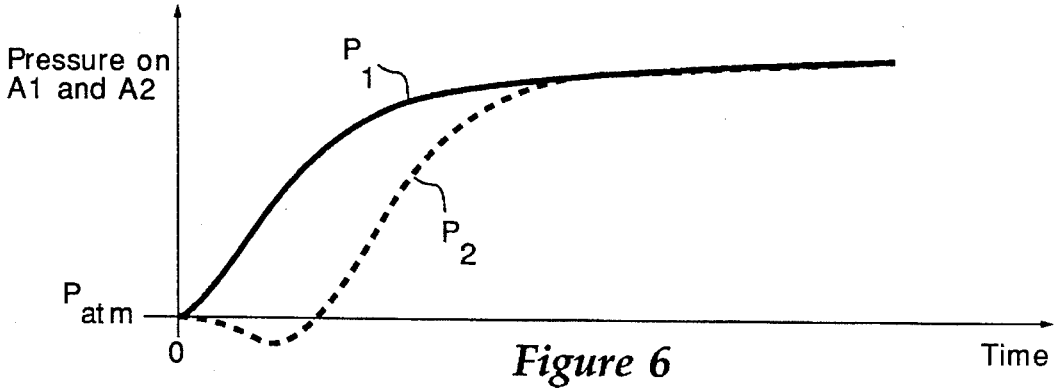
FIG. 6 is a graph showing the pressure acting on the first and second areas of the piston during the initial portion of an injection event.

Referring now to FIG. 4, an alternative embodiment of the present invention is illustrated. In this embodiment, area A1 is a portion of the conical protuberance and surrounds second area A2, which relationship is a reverse of the first embodiment. In the embodiment of FIG. 4, high pressure hydraulic fluid initially acts on annular area A1 causing piston 120 to move against the force of its return spring (not shown). Supply bore 119 is cut in injector body 111 to include a conically shaped seat 131 against which conical protuberance 121 of piston 120 seats. When seated, an expansion chamber 132 above area A2 of piston 120. Apart from the inverse relationship between area A1 and area A2, the embodiment of FIG. 4 performs in an identical manner to that of the earlier embodiment, and is likewise relatively easy to manufacture in large quantities with reliable predictive results.

Industrial Applicability

The present invention finds particular applicability in the field of hydraulically actuated fuel injectors. In such a case, a fluid driven piston is utilized to pressurize fuel to cause injection. Besides the function to provide "rate shaping", the present invention also extends the governable range of injection delivery quantities to provide lower delivery capabilities, and will improve the engine low idle quality due to extended injection durations. The present invention is relatively easy to manufacture in mass quantities with predictable injector behavior not previously possible with prior art designs. Although the present invention is illustrated in the context of a fuel injector, it could also find applicability in any fluid driven piston environment in which it is desirable to control the initial velocity of the piston.

It should be understood that the above description is intended only to illustrate the concepts of the present invention, and is not intended to in any way limit the potential scope of the present invention. For instance, those skilled in the art will immediately recognize the applicability of the present invention to other hydraulically actuated fuel injectors as well as other fluid driven piston devices. Those skilled in the art will also immediately recognize other geometrical interrelationships between the piston and its cylindrical bore that could produce the same results as the embodiments shown. In any event, the scope of the invention is defined solely by the claims as set forth below.

We claim:

1. A hydraulically actuated fuel injector comprising:

an injector body with a cylindrical cavity positioned between an actuation fluid supply bore and a fuel pressurization chamber, said cylindrical cavity being defined by a side wall and a top surface with a conically shaped seat;

a cylindrical piston mounted in said cavity and slidable between a first position and a second position and having a top side with a first area and a second area, and including a protuberance with a conical portion that seats in said conically shaped seat when said piston is in said first position;

means disposed within said injector body means for pressurizing fuel in said pressurization chamber during movement of said piston from said first position toward said second position;

means for biasing said cylindrical piston toward said first position;

said actuation fluid supply bore opening into said cylindrical cavity adjacent said top side of said cylindrical piston;

the actuation fluid being in fluid contact with said first area when said piston is in said first position but being in fluid contact with both said first area and said second area when said piston is away from said first position;

said second area of said piston and said cavity of said injector body defining an expansion chamber with a volume;

wherein movement of said piston from said first position toward said second position expands said volume of said expansion chamber;

wherein said conical portion of said protuberance and said conically shaped seat of said injector body define an actuation fluid flow area when said piston initially moves from said first position toward said second position; and said expansion chamber having an initial expansion rate limited by said actuation fluid flow area.

2. The fuel injector of claim 1, wherein said expansion chamber is substantially closed to said actuation fluid supply bore when said piston is in said first position.

3. The fuel injector of claim 2, wherein said first area and said second area are concentric about a piston axis.

4. The fuel injector of claim 3 wherein said first area surrounds said second area.

5. The fuel injector of claim 3, wherein said second area surrounds said first area.

6. The fuel injector of claim 1 wherein said actuation fluid flow area is less than the flow area of said actuation fluid supply bore.

* * * * *